United States Patent [19]

Hughes

[11] 4,094,397

[45] June 13, 1978

[54] TYPEWRITER SELECTION DRIVE FOLLOWER BLOCK AND SHUTTLE ASSEMBLY

[75] Inventor: Frank Marion Hughes, Paris, Ky.

[73] Assignee: International Business Machines Corporation, Armonk, N.Y.

[21] Appl. No.: 756,307

[22] Filed: Jan. 3, 1977

[51] Int. Cl.[2] ..... B41J 23/04

[52] U.S. Cl. ..... 400/161.4; 400/161.5; 400/317.2

[58] Field of Search ..... 197/16, 18, 52, 68; 74/57

[56] References Cited

U.S. PATENT DOCUMENTS

| | | | |
|---|---|---|---|
| 2,502,761 | 4/1950 | Stachowiak et al. | 74/57 |
| 2,539,921 | 1/1951 | Neisingh | 74/57 |
| 3,625,331 | 12/1971 | Waldenburger et al. | 197/18 |
| 3,739,899 | 6/1973 | Brumbaugh et al. | 197/68 X |
| 3,885,662 | 5/1975 | Schaefer | 197/52 |

*Primary Examiner*—Ernest T. Wright, Jr.
*Attorney, Agent, or Firm*—Laurence R. Letson

[57] ABSTRACT

A shuttle is disclosed which carries as part of its assembly at least a pair of follower blocks for providing the motion required to effect selection on a single element typewriter. The shuttle allows the follower blocks to provide the requisite motion and also allows a non-disengaging drive of the shuttle with the controlling driving shaft.

2 Claims, 2 Drawing Figures

TYPEWRITER SELECTION DRIVE FOLLOWER BLOCK AND SHUTTLE ASSEMBLY

CROSS REFERENCE TO INCORPORATED U.S. PATENT

Inasmuch as this specification describes and the claims are directed to an improvement on the mechanism and devices disclosed in U.S. Pat. No. 3,983,984 issued to Dirk de Kler on Oct. 5, 1976 and assigned to International Business Machines Corporation, on an application Ser. No. 590,737, filed June 26, 1975, the entire specification, drawing and claims are incorporated herein for purposes of disclosure and support of the appended claims.

BACKGROUND OF THE INVENTION

Single element typewriters of the type disclosed in the above identified patent, U.S. Pat. No. 3,983,984, rely upon the translational motion of a follower block in response to a detenting ball riding in a driving groove on a cyclically operated shaft.

It has been found that it is advantageous to engage a driving groove in the shaft in a relatively permanent manner, thus eliminating the possibility of improper disengagement and for re-engagement and also improving the reliability from a wear standpoint. To accomplish the variable selection necessary as described in the referenced patent and the ability to stop the follower blocks when they are fully engaging the control interposes as described in the de Kler patent, the control or follower blocks have been found to be advantageously moveably mounted and biased on the shuttle.

The disclosed assembly constitutes an improvement over the work of de Kler and is disclosed as such.

SUMMARY OF THE INVENTION

A shuttle is mounted for axial movement on a rotating shaft. The shaft is provided with a continuous cam like groove around its periphery providing a maximum degree of translation required for the rotate and tilt operations of the typewriter selection and type element positioning mechanisms. The shuttle is operatively engaged with this groove by means of a groove or cam following pin or protrusion therein engaging the shaft. The follower blocks which perform the same functions as the follower blocks 18 in the de Kler patent are mounted for reciprocatory motion on the rotating shaft and on the shuttle. The follower blocks are biased with respect to the shuttle to provide them with a home or inoperative position, by a constant force bias means, a flexed coil spring.

OBJECT OF THE INVENTION

It is an object of this invention to drive both the rotate and tilt follower blocks of a device as disclosed in U.S. Pat. No. 3,983,984 from a unitary shuttle.

It is a further object of this invention to yieldably urge the follower blocks of a device as illustrated and disclosed in the above referenced de Kler patent with a positive non-disengageable drive.

DESCRIPTION OF THE INVENTION

Figure 1:
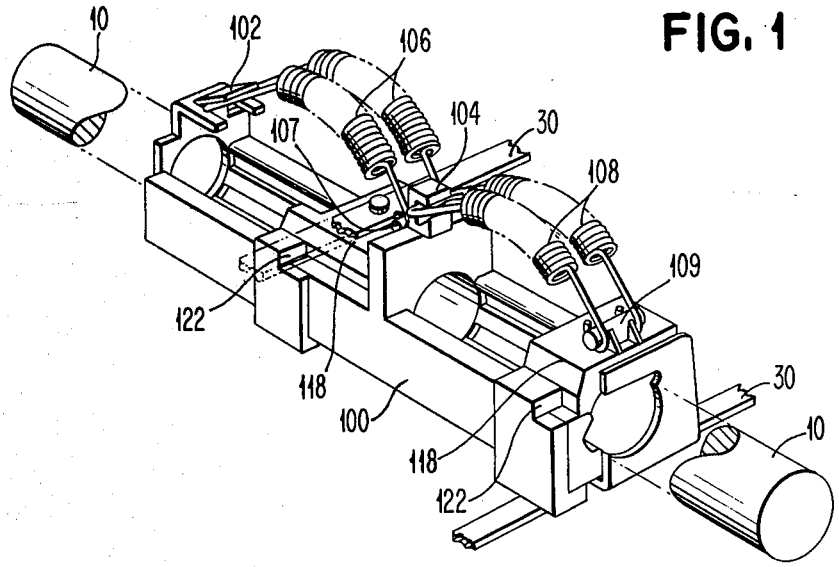
FIG. 1 is a perspective view of the shaft and shuttle assembly.
Figure 2:
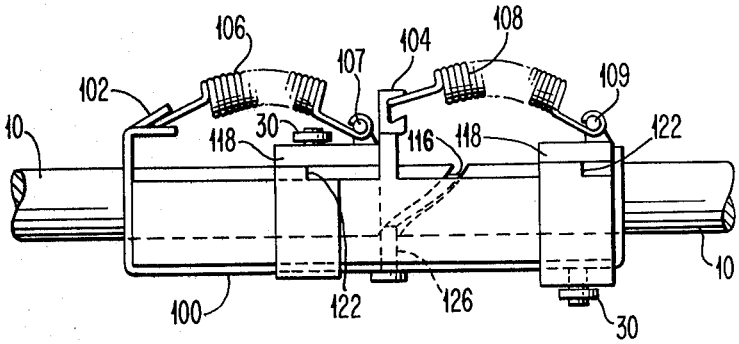
FIG. 2 is a front view of the shaft and shuttle assembly.

Referring to FIGS. 1 and 2 of this application, the reference numerals used herein will be identical to those used in U.S. Pat No. 3,983,984 for elements which are identical or full equivalents of each other. Reference numerals in the 100 series are used where elements are not identical or full equivalents of elements previously disclosed.

Rotatable shaft 10 has a cam groove 116 formed into its periphery. It is similar to groove 16 in the incorporated patent with the exception that the sides are formed to accommodate a follower stud 126 or member 126 of some cylindrical or elongated shape rather than a ball 28 as found in the incorporated patent. The elongated engaging member 126 extends from shuttle body 100. Carried on shuttle body 100 are follower blocks 118. Formed into follower blocks 118 are stop surfaces 122 which function with the same effect as stop surface 22 illustrated in FIG. 2 of U.S. Pat. No. 3,983,984. Follower blocks 118 are slidably mounted on shuttle body 100 and capable of translating axially of shaft 10. Shuttle body 100 is provided with holding members 102 and 104 for engaging and holding the ends of flexed coil springs 106 and 108 respectively. The flexed coil springs 106, 108 operatively engage the attachment points 107 and 109 respectively on follower blocks 118.

The above arrangement provides the capability of translating the shuttle body 100 and follower blocks 118 and flexed coil springs 106, 108 in response to the rotation of shaft 10. The engagement of follower stud 126 with cam groove 116 provides this oscillatory translation. The follower blocks 118 will translate with the shuttle body 100 until such time as an external force is exerted against one or both of the surfaces 122. Upon the engagement of an immoveable member 32 of U.S. Pat. No. 3,983,984 which would exert a force against one or both of these surfaces 122, follower block 118 will cease to translate and will be biased by flexible coil spring 106 or 108 to insure that it remains in abutment with whatever interfering member 34, of U.S. Pat. No. 3,983,984 is in the path of surface 122.

Flexible coil springs 106 and 108 provide a spring force which approximates a uniform force regardless of the amount of deflection. This is desirable since the spring loading does not increase with deflection as is normally the case with a standard linear compression spring.

Referring to FIG. 1 of U.S. Pat. No. 3,983,984, follower blocks 18 may be removed from the apparatus as disclosed, and replaced by the single shuttle body 100 carrying with it follower blocks 118. When this is accomplished, multiplier arms 30 may be attached to the follower blocks 118 in substantially an identical manner as illustrated in FIG. 2 of U.S. Pat. No. 3,983,984. Multiplier arms 30 may be attached at the top or bottom of the follower blocks 118 as shown in FIG. 1. Upon the completion of the modification of the apparatus of FIG. 1, the stop surfaces 122 will engage blocks 34 of interposers 42 in U.S. Pat. No. 3,983,984. Detailed explanation of this is contained in U.S. Pat. No. 3,983,984, with respect to surfaces 22. The operation and relations are identical.

As can be seen from the foregoing, engaging member 126 in FIG. 2 will always engage and remain in cam groove 116 and shuttle body 100 will therefore translate the full distance which is dictated by the rise of cam groove 116. This is an improvement over the arrangement disclosed in FIG. 2 of U.S. Pat. No. 3,983,984 since the stresses encountered upon the forcing of ball 28 from the groove 16 were sufficiently high to cause undesirable wear.

Secondly, the springs 106 and 108 provide a force against the blocks 34 through surface 122 thus insuring that follower block 118 will remain against the blocks 34 thereby providing an accurate mechanical movement which can accurately control the rotation and tilt of type element 60 in U.S. Pat. No 3,983,984.

With respect to all other elements of the device into which the shuttle assembly, as disclosed in FIGS. 1 and 2, is incorporated, the function is identical to that described with respect to FIG. 1 of U.S. Pat. No. 3,983,984.

I claim:

1. A shuttle assembly for use in a single element typewriter comprising:

a shuttle body, conformed to move axially over a rotating shaft;

a projection extending from the shuttle body toward the axis of said rotating shaft to engage a cam groove formed in the surface of said shaft;

at least one follower member;

biasing means for biasing said follower member against said shuttle body and in an axial direction, said follower member having a stop engaging surface thereon whereby said follower member upon the engagement of said engaging surface with a stop member will cease to translate and said shuttle body will continue to translate and said biasing means will provide a force through said follower member against said stop member.

2. The shuttle assembly of claim 1 wherein said biasing means is at least a single flexed coil spring.

* * * * *